US010429094B2

(12) United States Patent
Mavrommatis

(10) Patent No.: US 10,429,094 B2
(45) Date of Patent: Oct. 1, 2019

(54) WINDOW MOUNTED ROOM AIR CONDITIONER INSULATION AND INSTALLATION DEVICE

(71) Applicant: Demetrios Mavrommatis, Wellesley, MA (US)

(72) Inventor: Demetrios Mavrommatis, Wellesley, MA (US)

( * ) Notice: Subject to any disclaimer, the term of this patent is extended or adjusted under 35 U.S.C. 154(b) by 0 days.

(21) Appl. No.: 15/998,172

(22) Filed: Jul. 12, 2018

(65) Prior Publication Data

US 2018/0372372 A1 Dec. 27, 2018

Related U.S. Application Data

(63) Continuation-in-part of application No. 14/981,098, filed on Dec. 28, 2015, now abandoned.

(60) Provisional application No. 62/097,197, filed on Dec. 29, 2014.

(51) Int. Cl.
*F24F 13/32* (2006.01)
*F24F 1/027* (2019.01)

(52) U.S. Cl.
CPC ..... *F24F 13/32* (2013.01); *F24F 1/027* (2013.01); *F24F 2221/20* (2013.01); *F24F 2221/36* (2013.01); *F24F 2221/52* (2013.01)

(58) Field of Classification Search
CPC . E06B 3/263; F24F 5/0075; F24F 2005/0078; F24F 1/027; F24F 13/32; F24F 2221/20; F24F 2221/26
USPC ..... 52/27, 37, 62; 248/207–209; 454/199, 454/203, 204, 218
See application file for complete search history.

(56) References Cited

U.S. PATENT DOCUMENTS

| | | | | |
|---|---|---|---|---|
| 2,781,717 A * | 2/1957 | Hord | F24F 1/04 | 312/101 |
| 3,246,593 A * | 4/1966 | Jacobs | F24F 1/04 | 454/203 |
| 3,336,715 A * | 8/1967 | Savary | B21D 53/74 | 454/330 |
| 5,135,413 A * | 8/1992 | Pannizzo | E06B 7/28 | 174/481 |
| 8,117,786 B1 * | 2/2012 | Tobbe | E06B 5/01 | 52/19 |
| 9,347,217 B2 * | 5/2016 | Feuer | F24F 13/0263 | |
| 2014/0027587 A1 * | 1/2014 | Brown | F24F 13/32 | 248/201 |

* cited by examiner

*Primary Examiner* — William V Gilbert

(57) ABSTRACT

A window mounted room air conditioner insulation and installation device that assists with the efficient and effective installation of a window air conditioner, so that an indoor room environment remains relatively constant despite changes in external weather conditions or in internal heat loads.

1 Claim, 9 Drawing Sheets

WINDOW MOUNTED ROOM AIR CONDITIONER INSULATION AND INSTALLATION DEVICE

CROSS-REFERENCE TO RELATED APPLICATIONS

This application is a continuation in part of application Ser. No. 14/981,098

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of window mounted room air conditioner insulation and installation. Specifically, the present invention is about the insulation and installation of individual window mounted room air conditioner units used for domestic, consumer and commercial comfort applications. The insulation and installation provided by the present invention aims to provide an indoor room environment that remains relatively constant despite changes in external weather conditions or in internal heat loads.

A conventional window mounted room air conditioner unit is installed in an open window. As is true of all cooling appliances, a window mounted air conditioner unit must work harder when it is located in a poorly insulated room. Unfortunately, placing an air conditioner in a window requires keeping the window open and creates an opening between the inside and outside of the establishment. The spaces between the top and bottom window panes must be filled with multiple strips of insulating foam and use of duct tape is usually needed in order to adequately cover all the cracks and hole. The plastic curtains that slide in and out from the sides of the air conditioner will hardly keep, insects and bugs from entering the open window, and it won't stop hot air from coming into the room or cool air escaping outside either.

SUMMARY OF THE INVENTION

The present invention is window mounted room air conditioner insulation and installation device that it's quickly and easily installed that completely insulates the inside and outside area between the device and the individual window air conditioner unit, used for domestic, consumer and commercial comfort applications.

The advantage of the present invention, over the existing technology of the plastic accordion style panels, includes, without limitations, the ease of installing the device, in a more efficient and effective manner. Specifically, installation of the device does not require any tools or other material such as duct tape and the time to complete the installation of the new device is minimal. Another advantage of the new device over the plastic curtains that slide in and out from the sides of the air conditioner is that it will provide an overall much improve seal between the air conditioner unit and the window. Current technologies will hardly keep, insects and bugs from entering the room through the cracks on the open window, and it won't stop hot air from coming into the room or cool air escaping outside either.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE INVENTION

Figure 1:
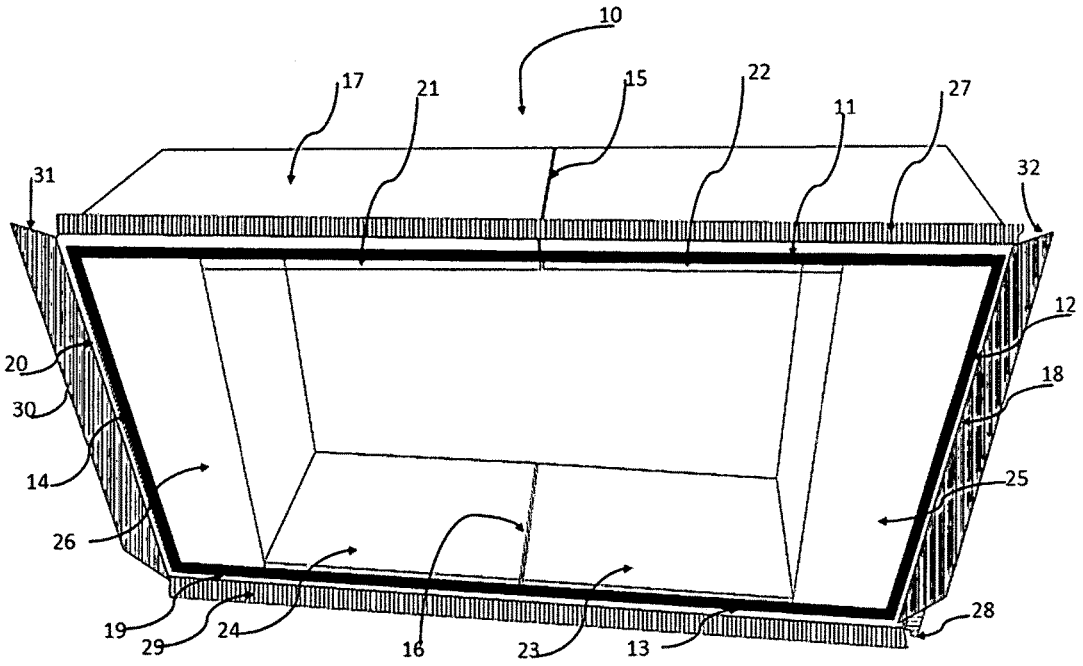
FIG. 1 is a front view of how the window mounted room air conditioner insulation and installation device looks like prior to adding the air conditioner unit.

Referring now to the invention in more detail, in FIG. 1, FIG. 2, FIG. 3, FIG. 4, and FIG. 5 there is shown a window mounted room air conditioner insulation and installation device 10, with all 4 of its inside hard foam walls, 11, 12, 13 and 14. The rectangular structure created by these 4 hard foam walls is what is referring to as the frame of the device. The frame is then use to attach all other foam related insulation material so that it composes an all-in-one device for the quick, efficient and effective installation and insulation of a window room air conditioner.

In further detail, still referring to the invention of FIG. 1, FIG. 2, FIG. 3, FIG. 4, and FIG. 5 each of the two horizontal walls 11 and 13, have a flexible and bendy middle area, 15 and 16 which is instrumental for the quick and easy installation on the window area. The two flexible and bendy middle areas (15-top and 16-bottom) when bended inwards, will allow the device to fit easier into the open window area and when released, they spring back into its original rectangular shape, which covers the whole window area. The two outside vertical edges of the device 12 and 14, will need to be pushed down to ensure that they touch firmly the actual window base for a better insulation experience.

The outside areas of all horizontal and vertical walls 11, 12, 13 and 14 are covered with a flexible but solid coat of foam 17, 18, 19 and 20 which are used to cover and insulate the areas between the window frame and the window mounted room air conditioner insulation and installation device.

The inside area of horizontal walls 11 and 13 are covered with a flexible but solid coat of foam 21, 22, 23 and 24. The inside area of the vertical walls 12 and 14 are also covered with a heavy-duty, waterproof foam but still flexible foam 25 and 26. There are also adhesive, heavy-duty tapes 27, 28, 29, and 30 all around the 4 inside (home facing) frame walls, 11, 12, 13 and 14 which will further enforce and enhance a tight seal between the device, the air conditioner unit and the window frame.

The two insulated flaps 31 and 32, attached to the outside perpendicular walls 12 and 14, are used primarily for insulation and cosmetic purposes. They are used to provide a better air seal between the air conditioner unit and the installation device and at the same time present a more aesthetic look of the device as a whole.

Figure 2:
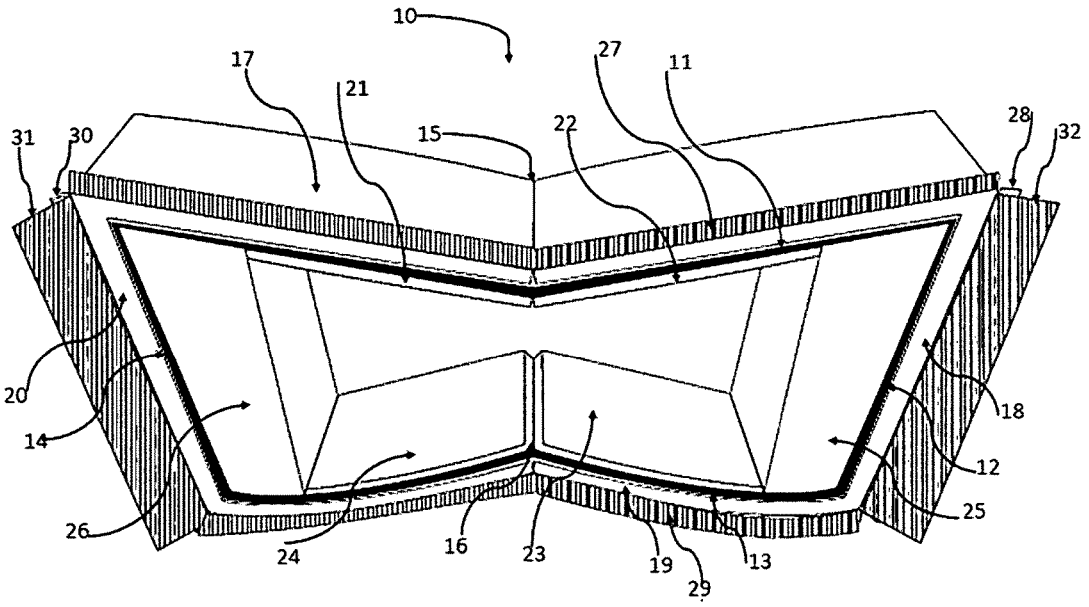
FIG. 2 is a front view of how the window mounted room air conditioner insulation and installation device is handled for easy and quick installation.

FIG. 2 is a front view of how the window mounted room air conditioner insulation and installation device is installed by bending inwards the two middle points 15 and 16 of the horizontal walls 11 and 13. Once the two middle points are released, the device will automatically spring back to its original rectangular shape.

Figure 3:
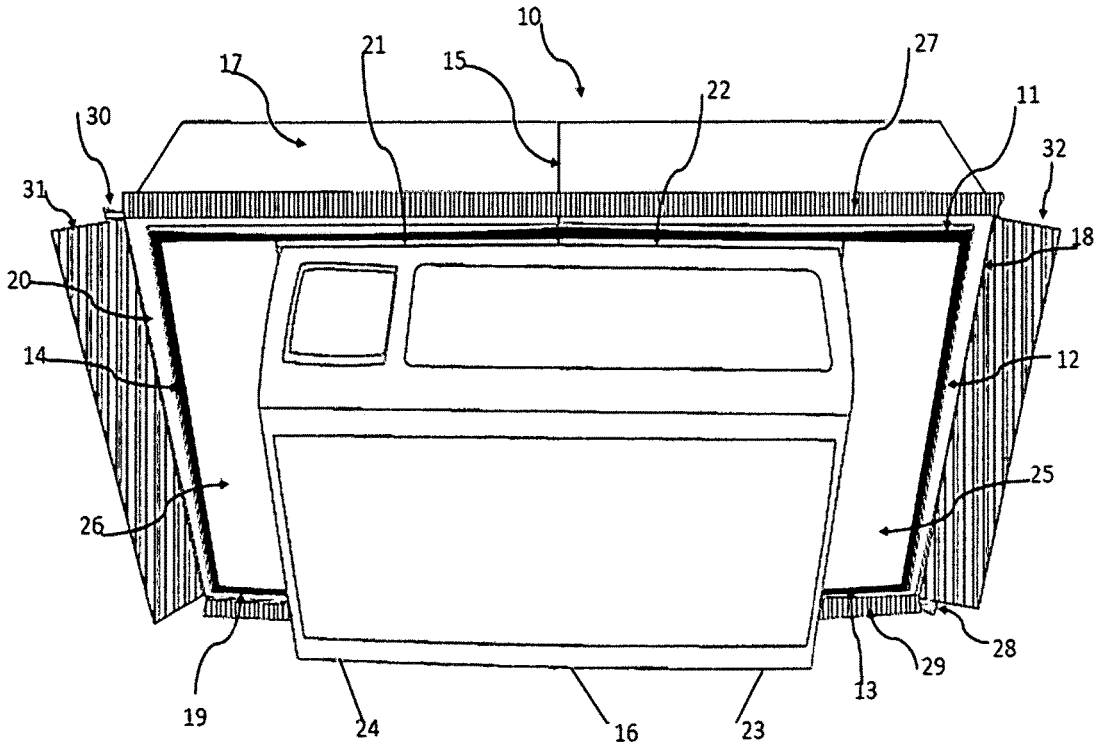
FIG. 3 is a front view of a window mounted room air conditioner insulation and installation device with an air conditioner unit added.

FIG. 3 is a front view of the window mounted room air conditioner insulation and installation device with a window room air condition unit installed 27. In order to install the air conditioning unit, you have to first open the insulated flaps 31 and 32 and then place it, halfway, sideways into the device and then push from right to left until the whole window air conditioner unit is firmly seated in the middle of the window mounted room air conditioner insulation and installation device. Move air conditioner unit slightly left and right so that it's seated in the middle of the window base.

Figure 4:
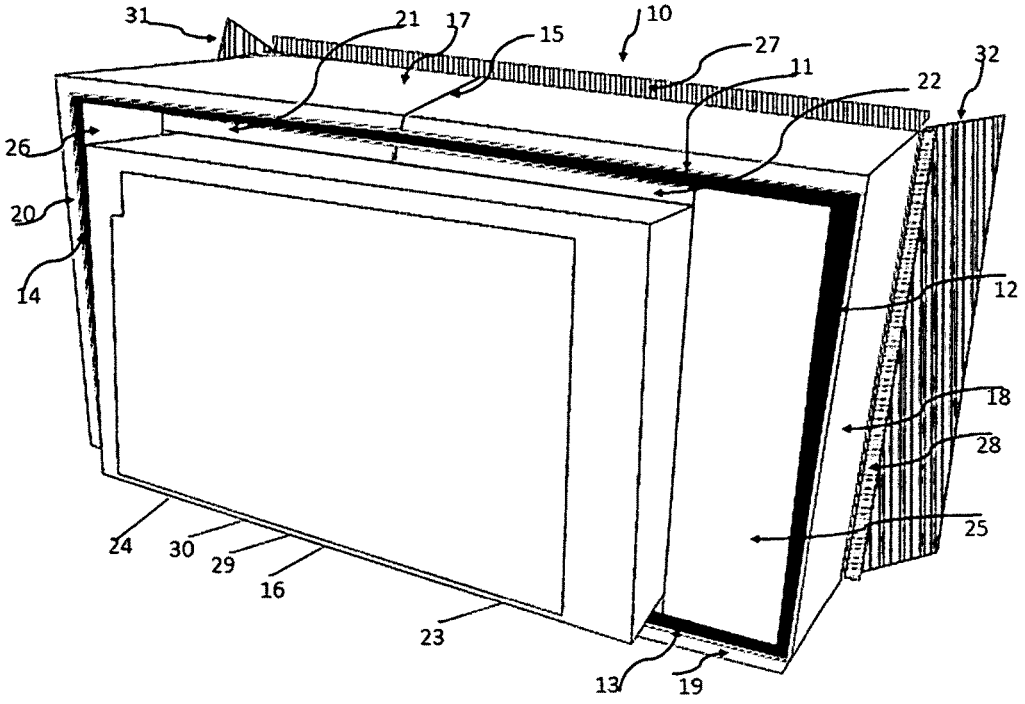
FIG. 4 is a back side view of the window mounted room air conditioner insulation and installation device with an air conditioner unit added.

FIG. 4 is a back side view of the window mounted room air conditioner insulation and installation device with a window room air condition unit installed 28.

Figure 5:
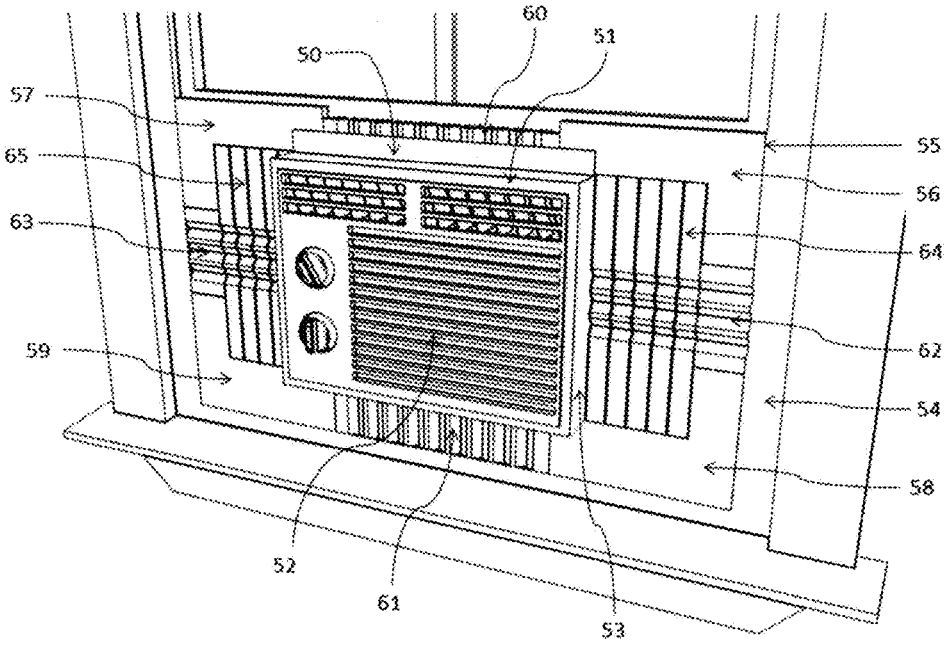
FIG. 5 is a front view of the flexible type window mounted room air conditioner insulation and installation device which allows various air conditioner size units, both in terms of width and height, be installed using a single device.

FIG. 5 is a front view of the flexible version of the window mounted room air conditioner insulation and installation device which allows various air conditioner size units, both in terms of width and height, be installed using the same device. This is made possible due to its flexible perpendicular wall areas 37 and 38 as well as the middle foam-only areas of 33, 34, 35 and 36. The flexible version of the window mounted room air conditioner insulation and installation device will cut down drastically on the number of individuals SKUs needed to accommodate all the different window and air conditioner unit sizes available in North America.

Figure 6:
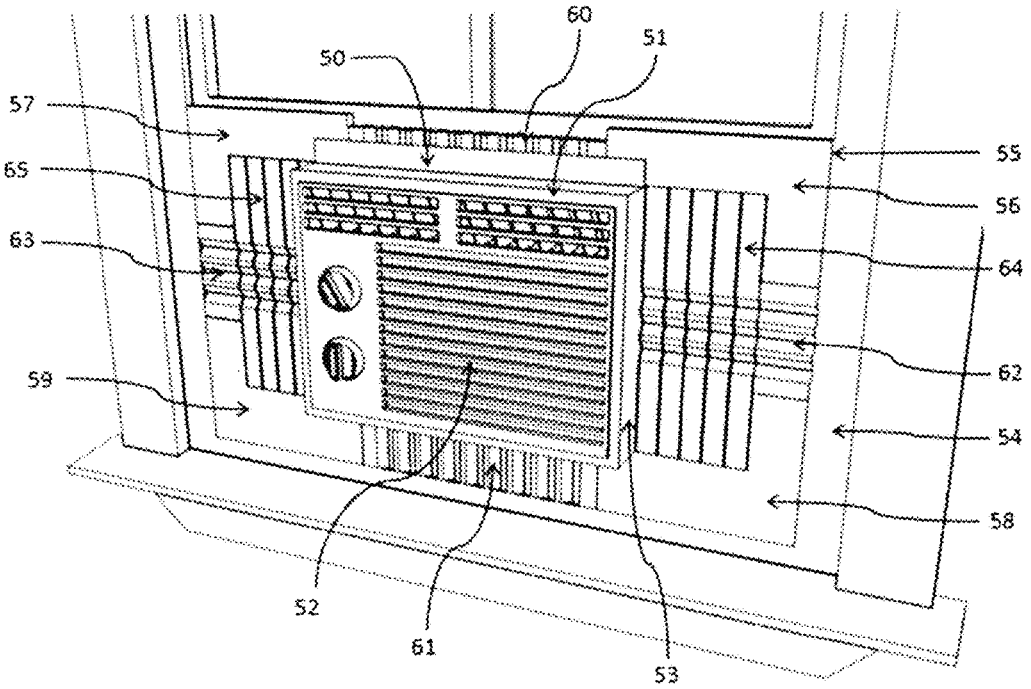
FIG. 6 is a front view of a window opening with window mounted room air conditioner insulation and installation device with an air conditioner mounted therein.

With particular reference to FIG. 6 of the drawing there is shown a room air conditioner 50 comprising a generally rectangular casing 51 adapted to be mounted within a window opening. The casing 51 of course, contains the usual components of an air conditioning apparatus for treating room air circulated through the casing by way of a grill 52 forming the front wall of the air conditioner. In mounting such an air conditioner in a window opening, the side walls 53 of the casing are usually spaced from the vertical side walls 54 of the window frame so that means must be provided for blocking such space or spaces. Such mounting arrangements are normally adjustable in order to accommodate or be applicable to window openings of various widths. The illustrated mounted room air conditioner insulation and installation device comprises a rectangular shape frame 55 including top-right 56, top-left 57, bottom-right 58 and bottom-left 59, L-shape members respectively, attached to adjustable and expandable dampers 64 and 65 and expandable gaskets 60, 61, 62 and 63 respectively. The opening or space defined by the rectangular shape frame 55 and the adjacent side wall 53 of the air conditioner casing is blocked or covered by multiple adjustable and expandable dampers 64 and 65 respectively. The adjustable and expandable dampers are made of a foam material such as cross-linked polyethylene foam and they are set prior to the air conditioner installation in the extended or retracted position.

This extended or retracted position is therefore the normal position for the adjustable and expandable dampers 64 and 65 and due to the characteristics of the material; it will tend to return to its original position when compressed.

Figure 7:
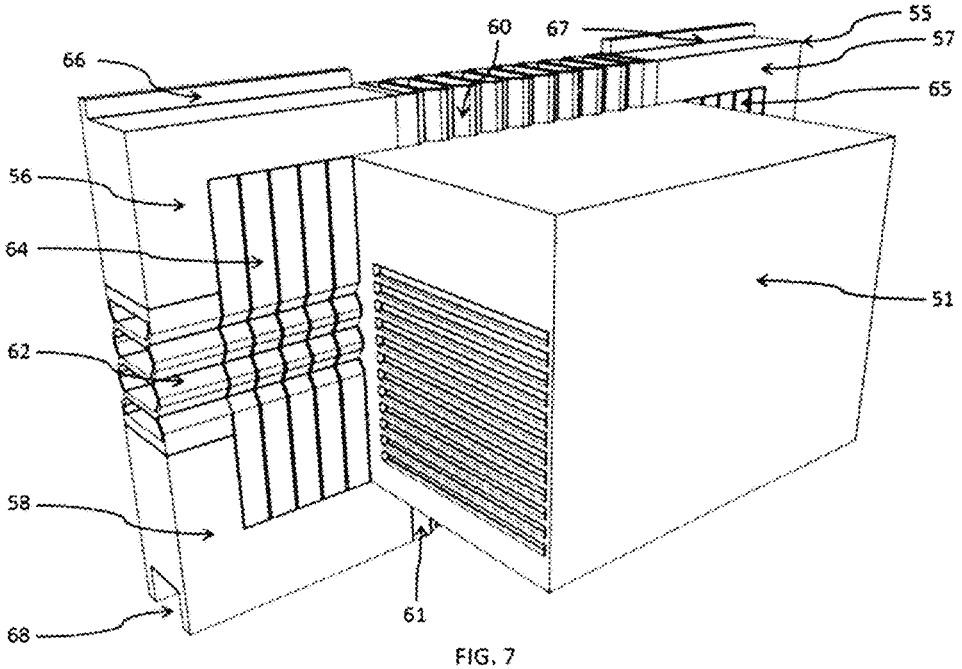
FIG. 7 is a back view of a window mounted room air conditioner insulation and installation device with an air conditioner mounted therein.

With reference to FIG. 7 of the drawing there is shown the back view of a room air conditioner 51 mounted within the window mounted room air conditioner insulation and installation device 55. The illustrated mounting arrangement comprises of a protracted upper strip 66 and 67 respectively that secures the said device against the lower window sash and a lower U-shape weather strip bridge 68 that secures the said device and protects the weather stripping of said window.

Figure 8:
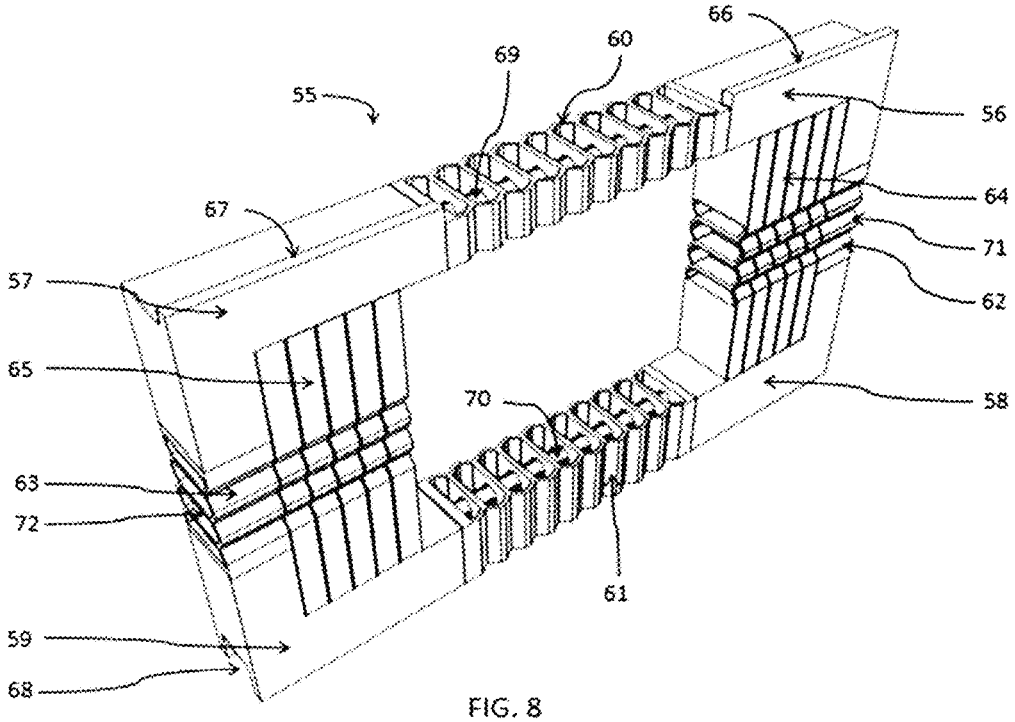
FIG. 8 is a front view of a window mounted room air conditioner insulation and installation device.

With reference to FIG. 8 of the drawing there is shown the front view the window mounted room air conditioner insulation and installation device 55. The sliding guides 69 and 70 respectively enable the device to retract and extend in size in order to accommodate or be applicable to various size air conditioners and windows openings of various widths. The sliding guides 71 and 72 (not shown) enable the device to retract and extend in size in order to accommodate or be applicable to various size air conditioners and windows openings of various heights.

The adjustable and expandable dampers 64 and 65 respectively within said device accommodate various size air conditioners and push against the air conditioner and the inside of the window mounted room air conditioner insulation and installation device creating a sealed condition and securing the air conditioner to the window mount.

The present invention is directed particularly to an improved insulation and secure installation where the protracted upper strip 66 and 67 respectively secures the said device against the lower window sash and a lower U-shape weather strip bridge 68 secures the said device and protects the weather stripping of said window. When is desired to remove the room air conditioner 50 and the window mounted room air conditioner insulation and installation device 55, all that is required is lifting the window sash up and compress adjustable and expandable dampers 64 and 65 respectively.

Figure 9:
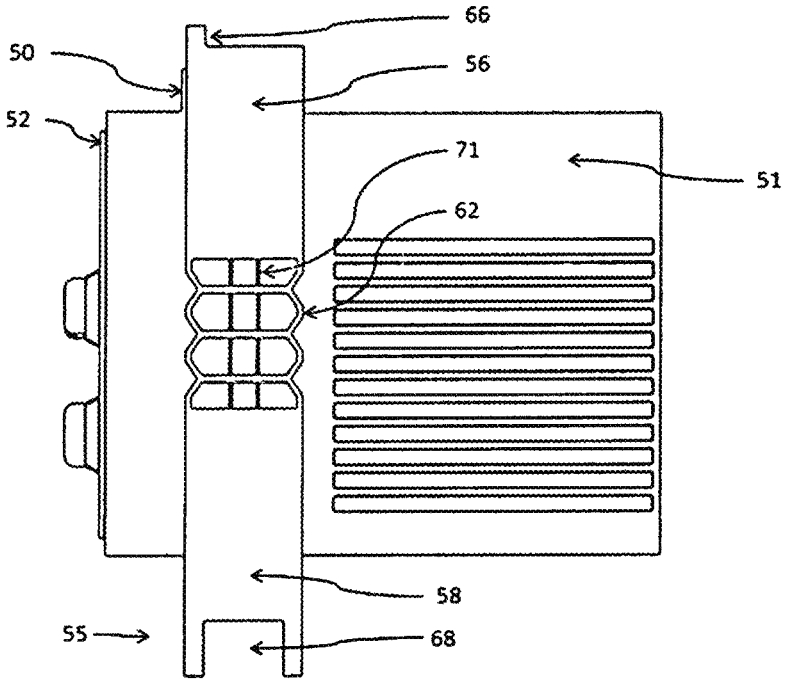
FIG. 9 is a side elevational view of the window mounted room air conditioner insulation and installation device with an air conditioner mounted therein.

With reference to FIG. 9 of the drawing there is shown a side elevational view of the window mounted room air conditioner insulation and installation device 55 with a window room air condition unit installed 50.

The illustrated mounting arrangement comprises of a protracted upper strip 66 that secures the said device against the lower window sash and a lower U-shape weather strip bridge 68 that secures the said device and protects the weather stripping of said window.

The sliding guides 71 enable the device to retract and extend its height size in order to accommodate or be applicable to various size air conditioners and windows openings of various heights. The expandable damper 62 made of a foam material such as cross-linked polyethylene foam is extended or retracted pending the size of the air conditioner and window opening.

The illustrated mounting arrangement comprises of a protracted upper strip 26 that secures the said device against the lower window sash and a lower U-shape weather strip bridge 28 that secures the said device and protects the weather stripping of said window. The sliding guides 31 enable the device to retract and extend its height size in order to accommodate or be applicable to various size air conditioners and windows openings of various heights. The expandable damper 22 made of a foam material such as cross-linked polyethylene foam is extended or retracted pending the size of the air conditioner and window opening.

The construction details of the invention as shown in FIG. 1, FIG. 2, FIG. 3, FIG. 4, FIG. 5, FIG. 6, FIG. 7, FIG. 8 and FIG. 9, are that the window mounted room air conditioner insulation and installation device 10 may be made of various materials such as foam, plastic, aluminum, wood, hard cardboard or any other sufficiently rigid and strong material such as high-strength cardboard, metal, and the like. Further the various components of the window mounted room air conditioner insulation and installation device 10 can be made of different materials as well.

The advantages of the present invention includes without limitations that insulation and installation provided by the present invention aims to provide an indoor room environment that remains relatively constant despite changes in external weather conditions or in internal heat loads. It also provides a tight insulation between the device and the window as well the device and the window mounted air conditioner unit. As a result the window mounted air conditioner unit does not have to work harder when it is located in a well-insulated room. Further, there is no need for placing random tapes or foam pieces in openings and cracks between the inside and outside of the establishment or the space between the top, bottom or sides of the window panes or the plastic accordion style curtains that slide in and out from the sides of the air conditioner unit.

Another advantage of the invention, due to the way its build, is the protection that provides to the actual window and specifically it's based, which bears most of the weight of the air conditioner unit. The device is also able to absorb part of the strong vibrations generated by the internal compressor of the air conditioner unit, which can be harmful to the window and the whole house when exposed to such strong vibrations for a long period of time.

Another advantage of the flexible version of the device as shown in FIG. 5 is that a single device can be used with many different sizes of air conditioner units, in terms of their width and height. For example a flexible window mounted room air conditioner insulation and installation device that is 19 inches wide and 15 inches tall, can be used with air conditioners ranging from 14 to 19 inches wide and 12 to 15 inches high.

In broad embodiment, the window mounted air conditioner device of the present invention could be any size as to fit on any window and support any window mounted air conditioner unit. The shape and the construction of the window mounted air conditioner device may be modified without being limited to the above description. For example, the outside area of all horizontal and vertical walls 11, 12, 13 and 14, which is used to cover and insulate the area between the window frame and the window mounted room air conditioner insulation and installation device may be made of different materials for enhance insulation as well as be modified in terms of size and shape to accommodate different styles and shapes of windows.

As will by now be evident to those of skill in this art, many modifications and variations are possible in the materials, methods and configurations of the window mounted air conditioner device of the present invention, without departing from its spirit and scope. Such changes and modifications are to be understood as being within the scope of the present invention as defined by the appended claims.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. An adjustable air-conditioner window mount comprising:

a first longitudinal member, a second longitudinal member opposite said first longitudinal member, a third longitudinal member and a fourth longitudinal member opposite said third longitudinal member, said first, said second, said third and said fourth longitudinal members forming an enclosure and having an opening extending therethrough, each said first, said second, said third and said fourth longitudinal members having a first longitudinal end and a second longitudinal end, said enclosure being bordered by a respective interior surface of each of said first, said second, said third and said fourth longitudinal members;

each said first, said second, said third and said fourth longitudinal members having at least a first expandable gasket located between a respective said first longitudinal end and said second longitudinal end, each said expandable gasket having an aperture extending therethrough;

each said expandable gasket having a sliding guide extending through a respective said aperture;

a protruding strip extending from a portion of a surface of said first longitudinal member that is opposite said interior surface of said first longitudinal member; and an expandable damper configured to be placed within said enclosure and having a first longitudinal end configured to abut said interior surface of said first longitudinal member and a second longitudinal end configured to abut said interior surface of said second longitudinal member, said expandable damper having an expandable gasket between said first longitudinal end and said second longitudinal end.

* * * * *